US005719381A

United States Patent [19]

Flückiger et al.

[11] Patent Number: 5,719,381

[45] Date of Patent: Feb. 17, 1998

[54] POSTAGE METER WITH HOLLOW ROTOR AXLE

[75] Inventors: Daniel Flückiger, Zäziwil; Christian Gillieron, Fraubrunnen; Kurt Nast, Bern, all of Switzerland

[73] Assignee: Ascom Hasler Mailing Systems AG

[21] Appl. No.: 421,900

[22] Filed: Apr. 14, 1995

[51] Int. Cl.[6] ..... G07G 1/00; G06C 25/00; B41L 47/46

[52] U.S. Cl. ..... 235/101; 235/130 R; 101/91

[58] Field of Search ..... 235/101, 130 R; 101/91

[56] References Cited

U.S. PATENT DOCUMENTS

| | | | |
|---|---|---|---|
| 4,140,054 | 2/1979 | Martin et al. | 101/91 |
| 4,326,460 | 4/1982 | Nuckel | 101/110 |
| 4,639,581 | 1/1987 | Berger et al. | 235/101 |
| 4,643,089 | 2/1987 | Salazar et al. | 101/91 |
| 4,656,341 | 4/1987 | Payn et al. | 235/101 |
| 4,682,541 | 7/1987 | Pollack, Jr. et al. | 101/91 |
| 4,730,821 | 3/1988 | Flückiger | 270/58 |
| 4,735,138 | 4/1988 | Gawler et al. | 101/91 |
| 4,759,283 | 7/1988 | Gilham et al. | 101/91 |
| 4,807,139 | 2/1989 | Liechti | 364/464.02 |
| 4,858,525 | 8/1989 | Hubbard et al. | 101/91 |
| 4,887,807 | 12/1989 | Berger et al. | 271/171 |
| 5,038,153 | 8/1991 | Liechti et al. | 346/140 |
| 5,060,821 | 10/1991 | Berger et al. | 221/190 |
| 5,203,263 | 4/1993 | Berger et al. | 101/76 |
| 5,237,506 | 8/1993 | Horbal et al. | 364/464.02 |
| 5,249,519 | 10/1993 | McChesney | 101/99 |
| 5,276,844 | 1/1994 | Aebi et al. | 395/425 |
| 5,278,541 | 1/1994 | Wicht et al. | 340/636 |
| 5,301,116 | 4/1994 | Grünig | 364/464.02 |
| 5,309,830 | 5/1994 | Vermesse | 101/91 |
| 5,340,965 | 8/1994 | Horbal et al. | 235/101 |
| 5,359,273 | 10/1994 | Flückiger | 318/794 |
| 5,363,760 | 11/1994 | Lindenmueller et al. | 101/91 |
| 5,389,863 | 2/1995 | Flückiger | 318/549 |

FOREIGN PATENT DOCUMENTS

| | | |
|---|---|---|
| 0062376 | 10/1982 | European Pat. Off. . |
| 0526139 | 2/1993 | European Pat. Off. . |
| 0526140 | 2/1993 | European Pat. Off. . |
| WO89/11134 | 11/1989 | WIPO . |

*Primary Examiner*—Michael L. Gellner
*Assistant Examiner*—Daniel Chapik
*Attorney, Agent, or Firm*—Oppedahl & Larson

[57] ABSTRACT

A postage meter has a secure housing, an accounting register within the secure housing, and a print rotor the rotation of which defines a paper path. The rotor axle is formed of two halves, and within the two haves is a lengthwise cavity along which setting racks are capable of axial movement. The racks engage with print wheels at one end and are accessible to the main body of the postage meter at the other end. Each rack engages with its value wheel in a rack-and-pinion engagement. The axle halves are made of plastic and they snap together. The racks slide within grooves, and are held in place with pins. The axle has journal bearings and a thrust bearing defining its movement relative to the secure housing. A worm gear in the housing engages a worm wheel in the rotor to bring about rotation of the rotor for the printing of postage.

11 Claims, 6 Drawing Sheets

POSTAGE METER WITH HOLLOW ROTOR AXLE

SPECIFICATION

The invention relates generally to postage meters (franking machines) and relates particularly to the design and configuration of the axle of the rotor of a postage meter.

BACKGROUND

A modern postage meter is partly mechanical and partly electronic. The electronic portion provides the man-machine interface, accounts for postage value, and supports many other functions including remote resetting of the meter. The mechanical portion is set to print the postage value, and then prints the postage value, all under control of the electronics. Each of the portions, electronic and mechanical, is subject to numerous design constraints. The portions cannot be too heavy, they must be extremely reliable, they must be secure against tampering, and they cannot be too expensive. In particular the mechanical portion should be strong, reliable, simple, and easy to assemble. It is desirable to keep the parts count as small as possible and to make the portion easy to assemble, and it is preferable to use inexpensive materials.

The majority of postage meters in use are meters having a print rotor that rotates to print postage value on the mail piece. The print rotor is mostly contained within a secure housing, and has value print wheels that are positioned to print particular digits on the mail piece.

The interface between the print rotor and the main body of the postage meter represents one of the most difficult aspects of the design of a postage meter. On the one hand it is necessary to provide linkages between the moving parts of the rotor (such as the value print wheels, the date wheels, and other movable indicia) and the moving parts of the main body (which control the setting of the print wheels and of other indicia). On the other hand the rotor has to be able to rotate quite readily to print postage. In the lifetime of a typical postage meter the rotor may rotate a million times. Thus the moving parts of the rotor come out of engagement, and back into engagement, with the moving parts of the main body, perhaps a million times.

The interface between the rotor and main body is also difficult because substantial forces are developed when a mail piece passes under the print rotor. For a clear postage value impression to be printed the rotor must receive substantial pressure from the mail piece, typically due to upward pressure from a platen lying below the paper path. The journal bearings holding the rotor must receive such forces and transmit them to appropriate structures within the main body of the meter.

The usual prior-art approach to rotor and axle design is to provide a metal H-shaped shaft or axle, joined to the print head or printing portion of the rotor. The H-shaped shaft has journal bearings at both ends and is longer in axial dimension than the print head. The H-shape defines channels on two faces of the shaft, and racks slide within the channels. The racks are caused to slide axially by setting mechanisms in the main body of the meter. The H-shaped shaft may be that shown in U.S. Pat. No. 4,639,581, assigned to the same assignee as the assignee of the present application. Such a prior-art shaft or axle is seen in plan view in FIG. 1A, and in cross-section view in FIG. 1B. Such a prior art approach presents some drawbacks. Substantial moments are developed in the structural elements joining the print head to the axle. The axle is not easy to assemble, since at various points during assembly it is necessary to hold racks in place (in the channels) while other parts are added to the assembly; the entire structure has to be held together as it is placed into the main body of the meter. The limited diameter of the axle also limits the total number of racks that can be disposed about the circumference of the axle. The accurate registration of the moving parts of the rotor in engagement with the moving parts of the main body of the meter is critical and great harm befalls the meter if setting attempts are made at a time when the registration is not correct.

SUMMARY OF THE INVENTION

A postage meter has a secure housing, an accounting register within the secure housing, and a print rotor the rotation of which defines a paper path. The rotor axle is formed of two halves, and within the two halves is a lengthwise cavity along which setting racks are capable of axial movement. The racks engage with print wheels at one end and are accessible to the main body of the postage meter at the other end. Each rack engages with its value wheel in a rack-and-pinion engagement. The axle halves are made of plastic and they snap together. The racks slide within grooves, and are held in place with pins. The axle has journal bearings and a thrust bearing defining its movement relative to the secure housing. A worm gear in the housing engages a worm wheel in the rotor to bring about rotation of the rotor for the printing of postage.

DESCRIPTION OF THE DRAWING

The invention will be described with respect to a drawing, of which.

DETAILED DESCRIPTION

Figure 2:
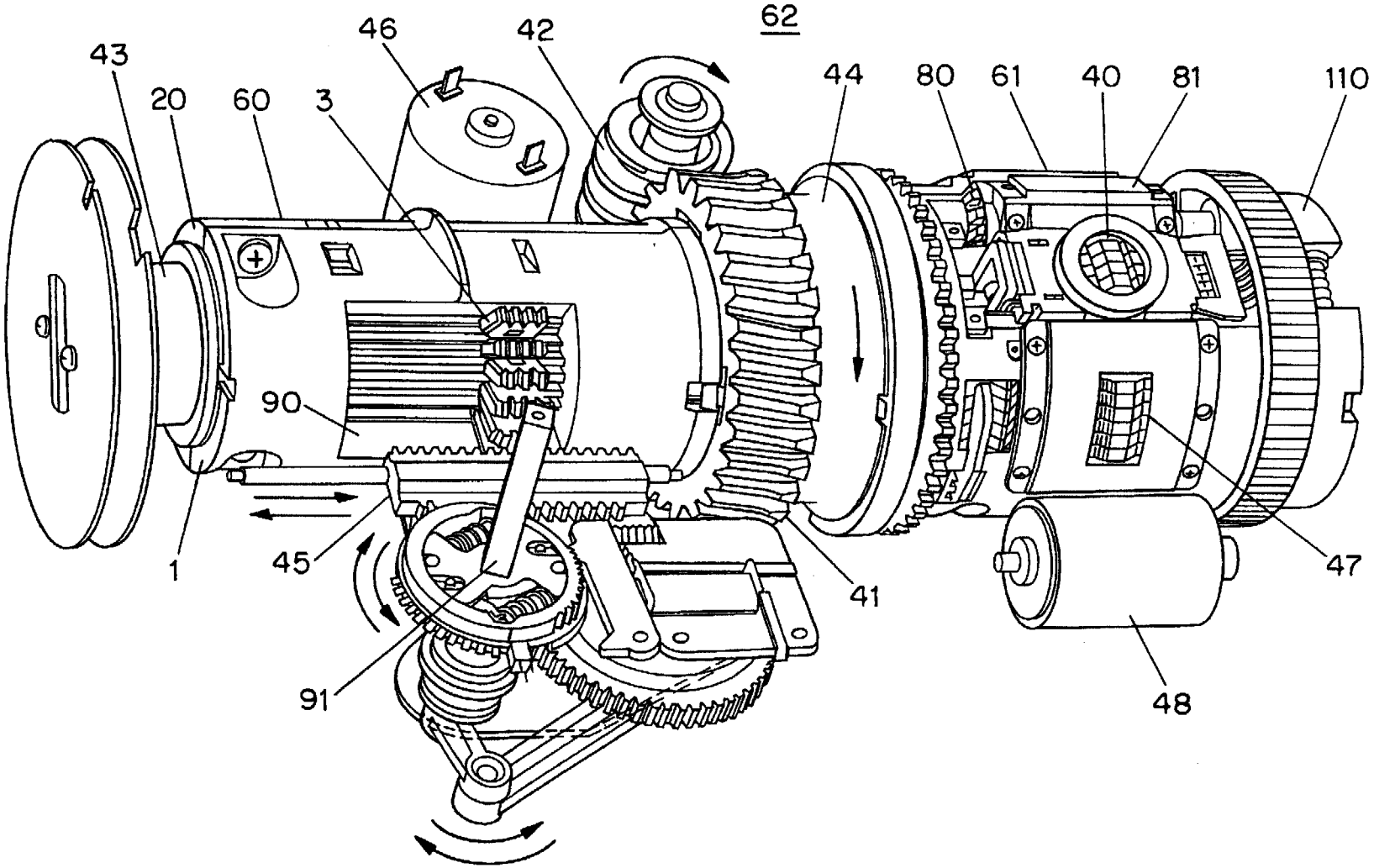
FIG. 2 is a perspective view of a print rotor and axle according to the invention.

FIG. 2 shows a perspective view of a print rotor and axle according to the invention, together with some of the moving parts in the main body of the postage meter. When postage is printed, the value wheels 47 come into contact with ink roller 48, and then come into contact with a mail piece as the rotor rotates. After the value wheels 47 come into contact with the mail piece, the date wheels 40 follow and subsequently come into contact with the mail piece. The rotor 62 rotates as a result of the rotation of the worm gear 42 which rotates in fixed relationship to the main body of the postage meter. The worm gear 42 engages the worm wheel 41 which is in fixed relationship to the rotor 62. Thus the worm gear rotates clockwise in FIG. 2 causing the rotor 62 to rotate in the direction shown. The worm gear 42 rotates under motive force from electric motor 46, as a result of gearing not visible in FIG. 2. The rotor 62 generally comprises axle 60 and print head 61. The mechanism that sets and rotates the rotor 62 may be that shown in copending application Ser. No. 08/422,155, filed Apr. 14, 1995, entitled Single-Motor Setting and Printing Postage Meter, which is incorporated herein by reference. The paper path may be improved in the manner set forth in U.S. application Ser. No. 08/403,461 filed Mar. 14, 1995, incorporated herein by reference. Date wheels in the rotor may be set by a mechanism set forth in copending application Ser. No. 08/421,902 entitled System for Setting Date Wheels in a Postage Meter, file Apr. 14,1995 and incorporated herein by reference. Racks and related moving parts in the rotor may be made more secure by means of techniques set forth in copending application Ser. No. 08/400,335, filed Mar. 7, 1995, which is incorporated herein by reference. In particular, it should be understood that herein, the terminology of rack-and-pinion engagement, which is used to describe how each rack engages with its value wheel, should be understood to include cog racks and cog teeth.

Most of the time the rotor 62 is in a "home" or "rest" position with respect to the main body of the postage meter. It departs from its home position only when postage is being printed. FIG. 2 portrays the rotor in its home position.

Figure 3:
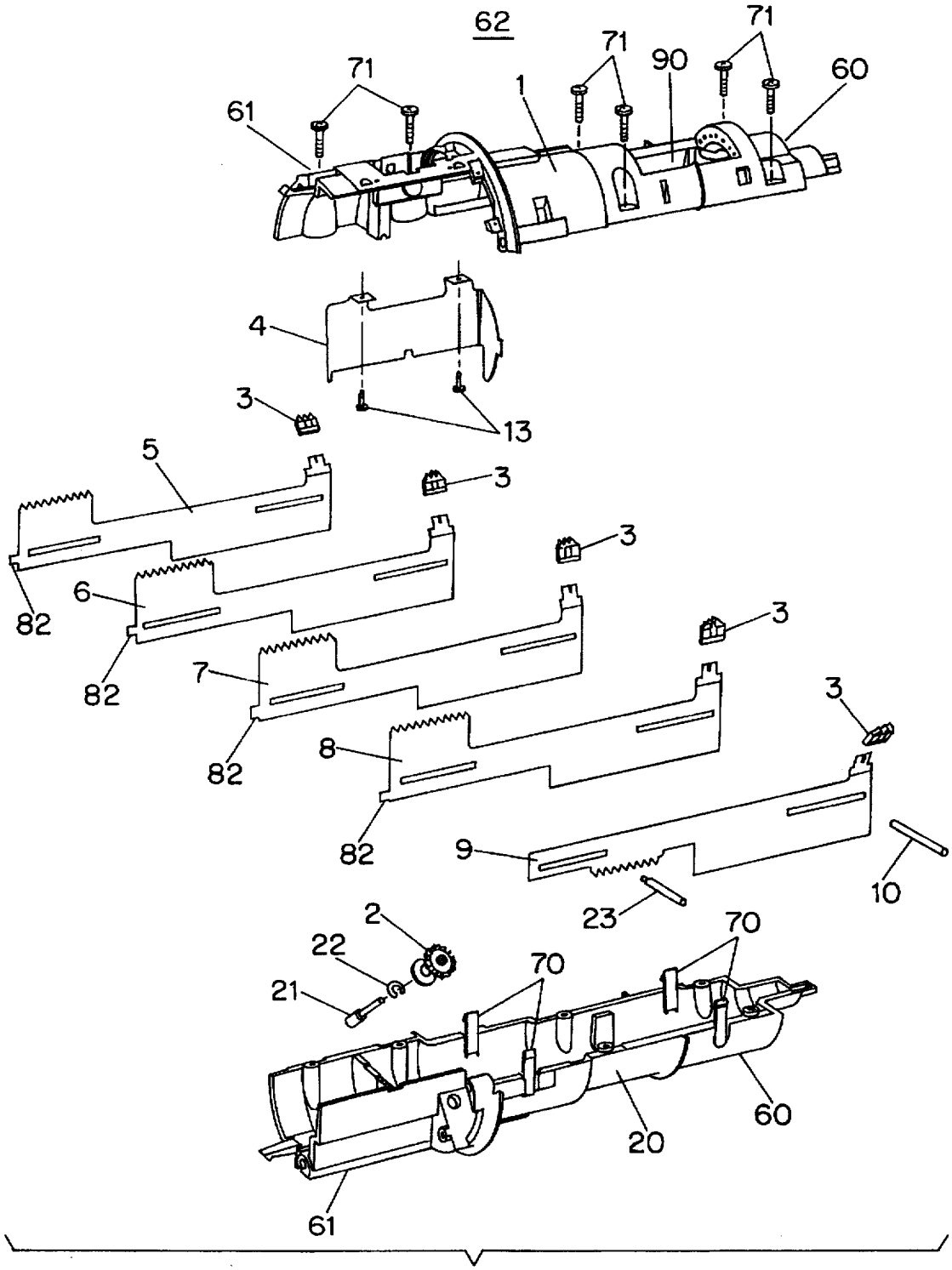
FIG. 3 is an exploded view of a portion of the print rotor and axle of FIG. 2.

Turning now to FIG. 3, what is shown is an exploded view of a print rotor 62 according to the invention. The rotor 62 comprises a print head 61 and an axle or shaft 60. The rotor is composed of at least two subcomponents, preferably two components 1 and 20, made of engineering plastic. The components 1 and 20 are preferably joined by snap-fit features 70 in piece 20 (and matching recesses in piece 1) and are optionally also joined by screws 71 which are preferably self-forming screws.

Figure 1A:
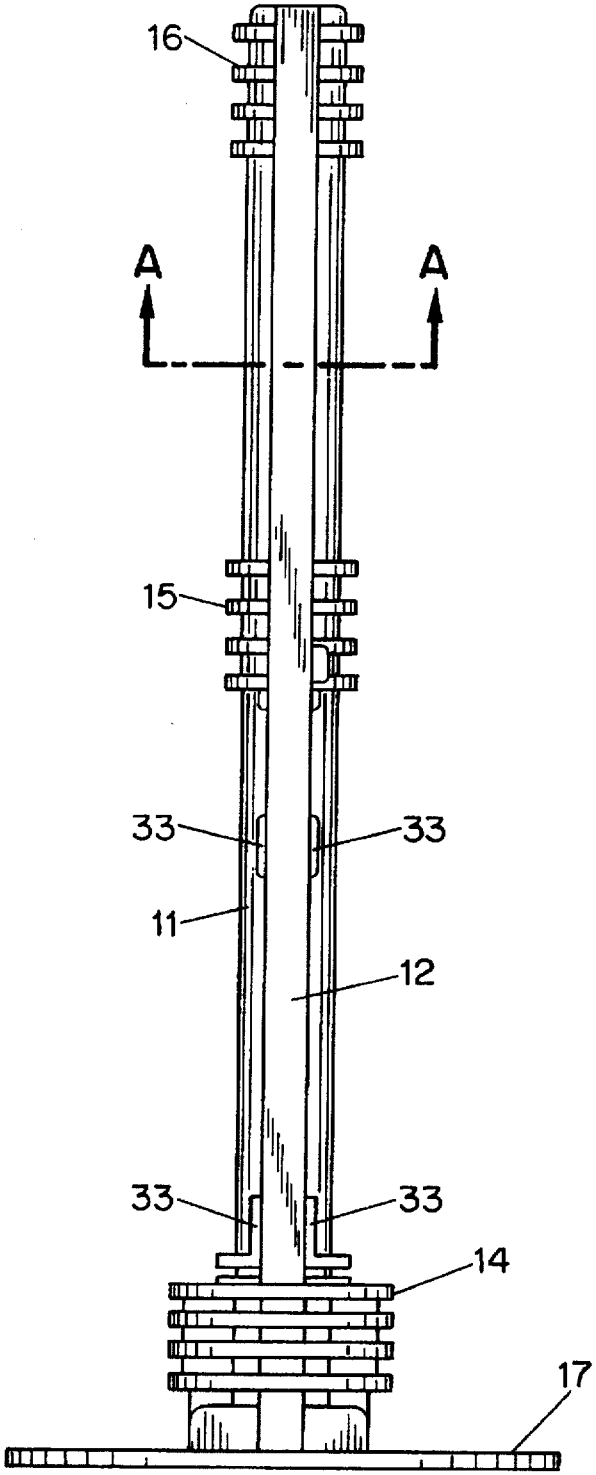
FIG. 1A PRIOR ART
FIG. 1A is a plan view of a prior-art postage meter rotor axle.
Figure 1B:
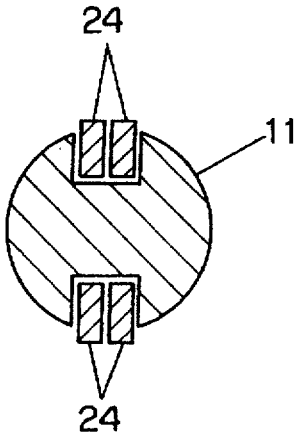
FIG. 1B PRIOR ART
FIG. 1B is a cross-section view of the prior art axle of FIG. 1A, taken on section A.

In accordance with the invention, racks 5, 6, 7, 8, and 9 are disposed within a hollow core or cavity within axle 60. This is in contradistinction with the racks 24 (FIG. 1B) that are located externally to shaft 11. The racks 5–9 are each held by corresponding grooves set within the inner faces of the portions 1, 20. Furthermore, the racks 5–9 are constrained in movement by pins 10, 23. The pins 10, 23 rest in matching grooved features in the inner face of the portions 1, 20. Each of the racks 5–9 has a first end and a second end. The second ends each receive toothed caps 3 which in turn engage moving parts in the main body of the meter. The first ends are preferably formed into toothed racks as shown in FIG. 3, and the first ends of racks 4–8 engage in conventional fashion with gears that are preferably integrally formed with the value wheels 47, omitted for clarity in FIG. 3. In this way, returning to FIG. 2, the sliding racks 45 are able to accomplish precision control of the positions of the value print wheels 47.

Figure 7:
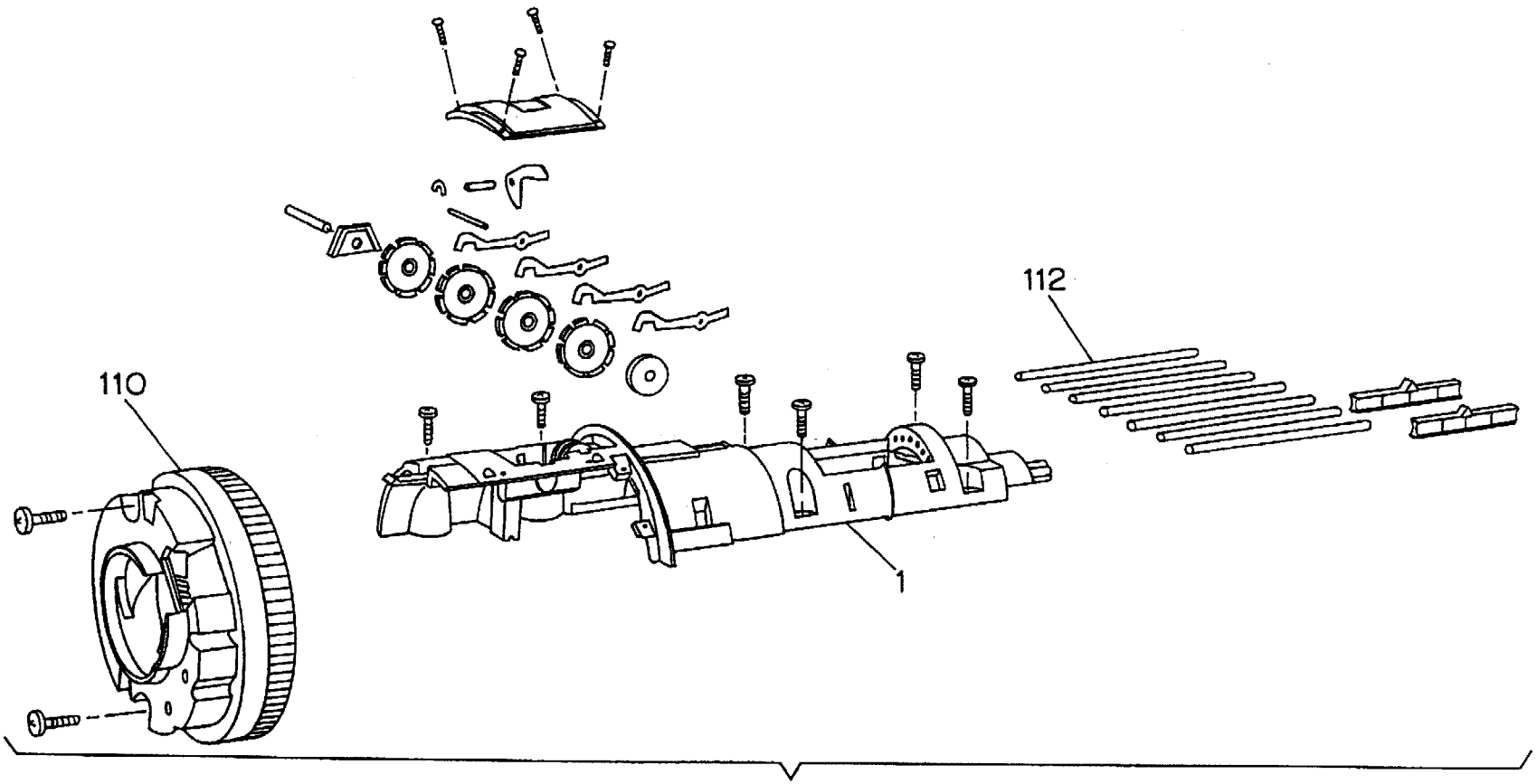
FIG. 7 is an exploded diagram for a portion of the rotor, including end cap 110.

The toothed caps 3 are held in place by guide rods 112, visible in the exploded diagram of FIG. 7.

It will be noted that the number of racks portrayed in FIG. 3 (e.g. 5) exceeds the number of value print wheels (e.g. 4). This is because rack 9 controls other moving parts in the print head 61, namely the shaft 21 and bevel gear 2, which in turn rotates a matching bevel gear 80 (FIG. 2) and thus rotates a four-sided mail class die 81. Thus, while there is a rack corresponding to and engaged with each value wheel 47, it is not the case that there is a value wheel 47 for each rack.

Features 82 (FIG. 3) located at the ends of the racks 5–8 are disposed to cause indexing movement of ratchets (omitted for clarity in FIG. 3) to advance the positions of the date wheels 40. It will be appreciated that the racks 5–9 are substantially planar and parallel to each other. It will also be appreciated that the toothed caps 3 are angled at a sequence of angles to subtend an arc defined by the opening 90, which may be seen in FIGS. 2 and 3.

Returning to FIG. 2, toothed caps 3 are visible through opening 90 and engage with sliding racks 45, only one of which is shown with its four counterparts 45 omitted for clarity.

Figure 4:
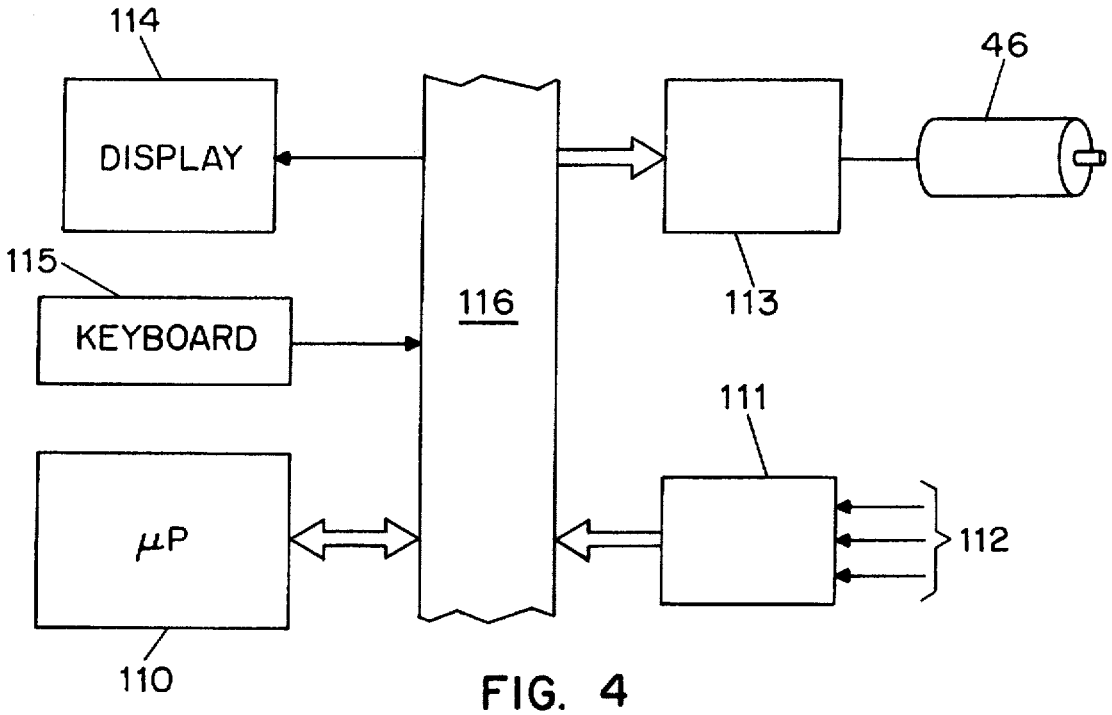
FIG. 4 shows the electronics of the postage meter in functional block diagram.

FIG. 4 shows in functional block diagram form the electronics of the postage meter. Processor 110 executes a stored program to bring about the normal function of the meter. Processor 110 communicates by bidirectional bus 116 with the balance of the electronics. The man-machine interface is provided chiefly by keyboard 115 and display 114. Output ports 113 permit the processor to control the motor 46 and other electromechanical elements of the postage meter. Input ports 111 receive sensor inputs from various parts of the meter and permit the processor 110 to be informed of the mechanical states and positions of moving parts of the meter.

As may be appreciated in connection with FIG. 3, assembly of the rotor is facilitated by the two-piece structure of the rotor 62. The "bottom" piece 20 may be placed in a holder for assembly, and racks 5–9 are lowered into place in corresponding grooves in the inside face of piece 20, with pins 10, 23 in place. The "top" piece 1 is then lowered into place and snapped onto piece 20. As a result, the racks 5–9 are captive for the remainder of the assembly process, and other rotor parts may be mounted to the pieces 1 and 20.

Alternatively, the piece 1 may be treated as the "bottom" piece, with its concave inner surface upwards. An assembly containing the value wheels 47 is set into place and secured. Next, the racks 5–8 are dropped into place, aligned by an assembly jig, in engagement with the gear portions of the value wheels 47. Then the "top" piece 20 is snapped into place.

Figure 5:
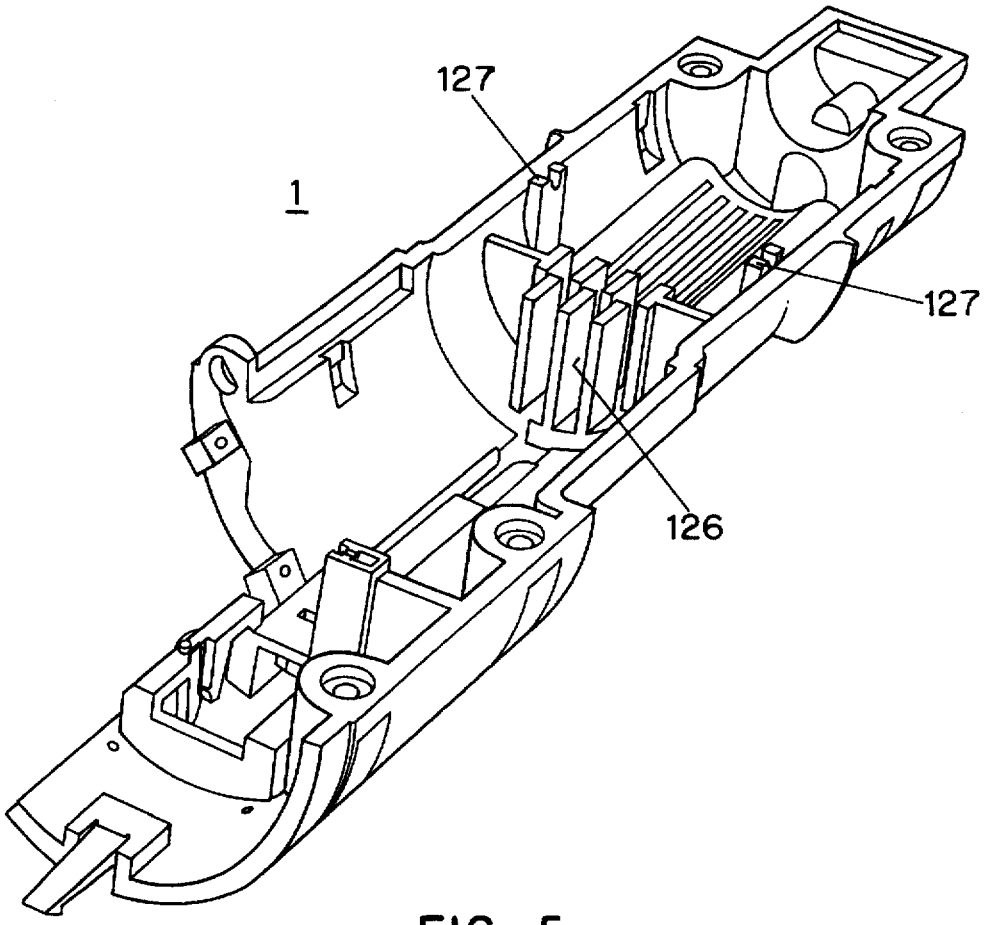
FIG. 5 shows the interior structure of the rotor piece 1 in more detail in perspective view.
Figure 6:
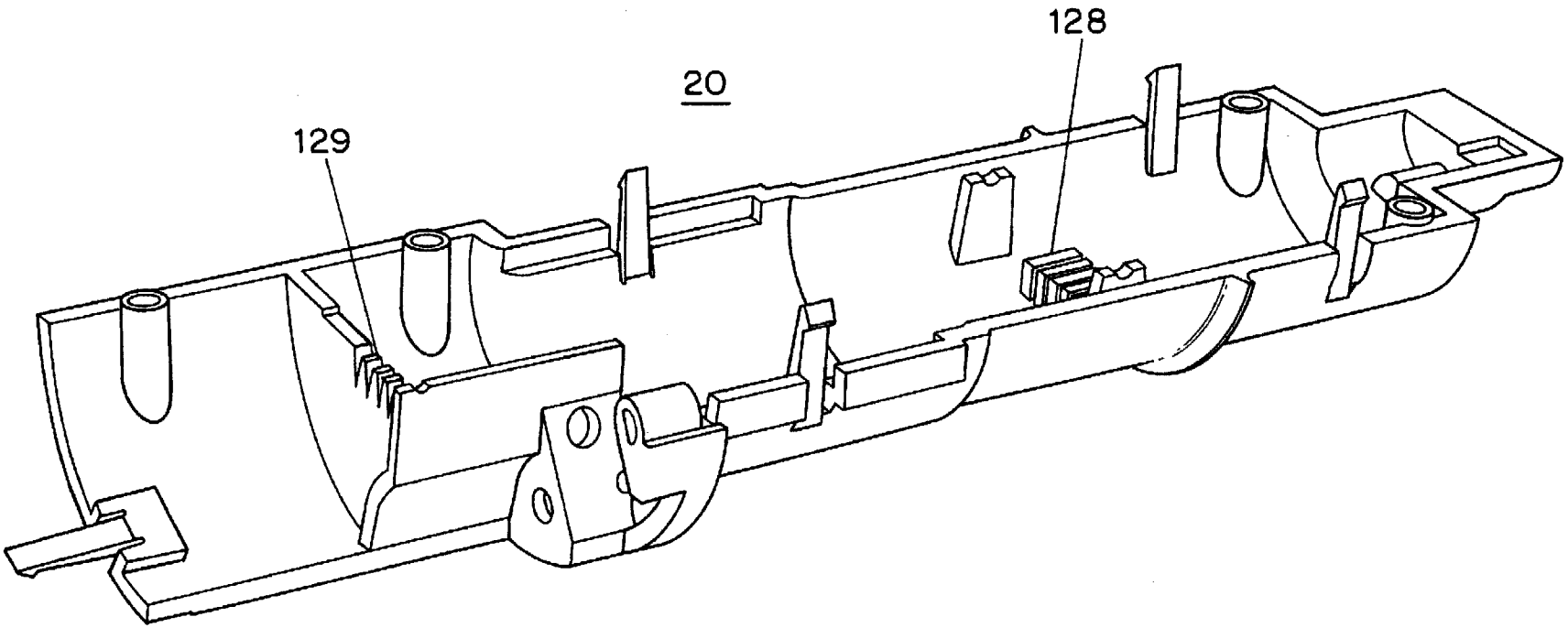
FIG. 6 shows the interior structure of the rotor piece 20 in more detail in perspective view.

Turning now to FIG. 5, what is seen is a perspective view of the inside of bottom piece 1. Grooves 126 may be seen, which guide the racks during and after assembly. Saddles 127 are shaped to receive pin 23. FIG. 6 shows top piece 20. Grooves 128 may be seen which also guide and hold the racks during and after assembly. Grooves 129 hold the racks in proximity with the value wheels of the rotor.

FIG. 7 shows guide rods 112 which help to position the toothed ends of the racks. End cap 110 also appears in FIG. 7. End cap 110 is snapped on to the balance of the rotor.

What has been described is a strong, simple rotor print head and axle design. It is easy to assemble and does not have too many moving parts. The design is also robust against attempts to tamper with the rotor to print postage that is not paid for. In prior art designs it might be though that one could force a wheel 47 to "jog" (rotate and jump a tooth position) relative to a corresponding rack 5–8. This would permit printing postage in an amount differing from the amount which the processor 110 expects to print. But as pin 23 is directly below the value wheels (in FIG. 3) the result is that the pin 23 is in fixed mechanical relationship to the common shaft holding the value wheels; this makes it nearly impossible to jog a print wheel. In the same way, pin 10 (FIG. 3) is in fixed mechanical relationship with the shaft 91 (FIG. 2) so that it is impossible to jog the toothed cap 3 relative to the sliding racks 45 or the associated moving parts.

Those skilled in the art will readily devise obvious variations of the embodiments set forth herein without departing from the invention, which is defined by the claims which follow.

What is claimed is:

1. A postage meter comprising a secure housing, an accounting register within the secure housing, and a print rotor the rotation of which defines a paper path; said rotor further comprising an axle contained within the secure housing, said rotor rotating about the axis of said axle, said rotor further comprising a plurality of value print wheels and a plurality of racks each having a first end and a second end, each of said racks corresponding with a respective one of the the print wheels, its first end mechanically engaged therewith; said axle comprising at least first and second portions each portion extending along a majority of the axial length thereof, said first portion in fixed position relative to said second portion, said first and second portions shaped to define a cavity extending along a majority of the axial length thereof, said racks disposed within said cavity and movable axially therewithin, each of said racks surrounded along a portion of its length by said first and second portions; said first and second portions further shaped to define an opening, the second ends of the racks positioned at the opening; said axle further comprising guide means disposed within the axle constraining the racks from movement other than axial movement.

2. The postage meter of claim 1 in which each of the value print wheels further comprises a pinion integrally formed therewith and in which the engagement between each print wheel and its rack is rack-and-pinion engagement.

3. The postage meter of claim 1 wherein the first and second portions meet at a substantially planar area and are joined with snap-fit features.

4. The postage meter of claim 1 wherein the guide means comprises grooves formed within the cavity, said grooves in sliding engagement with the racks.

5. The postage meter of claim 4 wherein the racks each have first and second lengthwise slots, said meter further comprising first and second pins, said first pin passing through the first slots of the racks and said second pin passing though the second slots of the racks.

6. The postage meter of claim 1 further comprising plastic toothed ends corresponding in number to the racks and located at the second ends thereof.

7. The postage meter of claim 1 wherein the racks are metal and the first and second portions are plastic.

8. The postage meter of claim 7 wherein the first and second portions meet at a substantially planar area and are joined with snap-fit features.

9. The postage meter of claim 1 further comprising bearings located at first and second axial positions along said axle.

10. The postage meter of claim 1 further comprising a worm wheel surrounding and fixed to said axle, said worm wheel engaging a worm gear disposed within the secure housing.

11. The postage meter of claim 10 wherein the worm wheel is disposed between the value wheels and the opening.

* * * * *